US005944409A

United States Patent [19]

Chen

[11] Patent Number: 5,944,409

[45] Date of Patent: Aug. 31, 1999

[54] STRUCTURE OF LIGHT HOOD ASSEMBLY

[76] Inventor: Frank Chen, 8F-6, No. 100, Sec. 2, Hoping East Road, Taipei, Taiwan

[21] Appl. No.: 08/866,899

[22] Filed: May 30, 1997

[51] Int. Cl.[6] ..... F21V 17/00

[52] U.S. Cl. ..... 362/257; 362/278; 362/376

[58] Field of Search ..... 362/278, 300, 362/311, 322, 341, 376, 257

[56] References Cited

U.S. PATENT DOCUMENTS

| | | | |
|---|---|---|---|
| 5,660,464 | 8/1997 | Lin | 362/376 |
| 5,718,506 | 2/1998 | Yeh | 362/376 |
| 5,845,988 | 12/1998 | Mandall | 362/376 |

*Primary Examiner*—Y. Quach

*Attorney, Agent, or Firm*—Rosenberg, Klein & Bilker

[57] ABSTRACT

This invention is concerned of the structure of Light Hood Assembly. It consists of an outer hood, reflection hood, glass tube and fixed chips. The reflection hood and the glass tube are placed inside of the positioning slot of the outer slop. The reflection hood is positioned upon its own tension. The fixed chips are screwed to the outer hood to press the reflection hood and the glass tube unto their positions, in which the assembly is completed; by following above structure, it will reach the effects of quick assembly simple component and easy production.

This invention concerns to a Structure of Light Hood Assembly. It provides for quickness of assembly and simplicity of component which leads to cost decreasing of its manufacture.

1 Claim, 4 Drawing Sheets

STRUCTURE OF LIGHT HOOD ASSEMBLY

DESCRIPTION OF THE PRIOR ART

With the advancement of living standard, lighting and its decoration are gradually receiving more attention from people. An interior decoration comes with an appropriate lighting decoration will serve the purposes of beauty as well as practice.

Please refer to Diagram 1 and 2, which are 3-D assembled diagram and 3-D dissected diagram in description of above mentioned light hood. The structure of the light hood consists of, mainly, an outer hood (10*a*), a reflection hood (11*a*), a glass tube (12*a*) and two fixed chips (13*a*). The reflection hood is placed inside of the outer hood (10*a*). The glass tube (12*a*) is positioned inside the reflection hood (11*a*). Then the two fixed chips (13*a*) are screwed unto the inside of the outer hood (10*a*) with 2 screws (14*a*). By using the two fixed chips (13*a*) to press reflection hood (11*a*), in which to enable reflection hood (11*a*) be fixed unto the inside of the outer hood (10*a*). Also, to insert the two positioning chips (15*a*) on the two ends of the fixed chips (13*a*) into the positioning holes (16*a*) of the reflection hood (11*a*), which makes the reflection hood (11*a*) stable. In addition, there are two convex chips (17*a*) are set on the edges of the fixed chips (13*a*), it could use these convex chips to press two ends of the glass tube (12*a*), which will fix the glass tube (12*a*) at the inside of the reflection hood (11*a*). This light hood can be appropriately connected with lighting decoration via the upper end of the supporting arm (18*a*). The Light bulb (19*a*) is positioned inside the glass tube, and such glass tube will provide the function of protection to the user in case the bulb explodes.

The light hood as described above is quite complicated in assembling and could not serve the purpose of quick assembly. In addition, its reflection hood, glass tube and its fixed chips as well as other component parts all are in a complicated form of structure. It is difficult to manufacture and thus to lead to the increase of manufacturing cost.

DETAILED DESCRIPTION OF THE INVENTION

Figure 1:
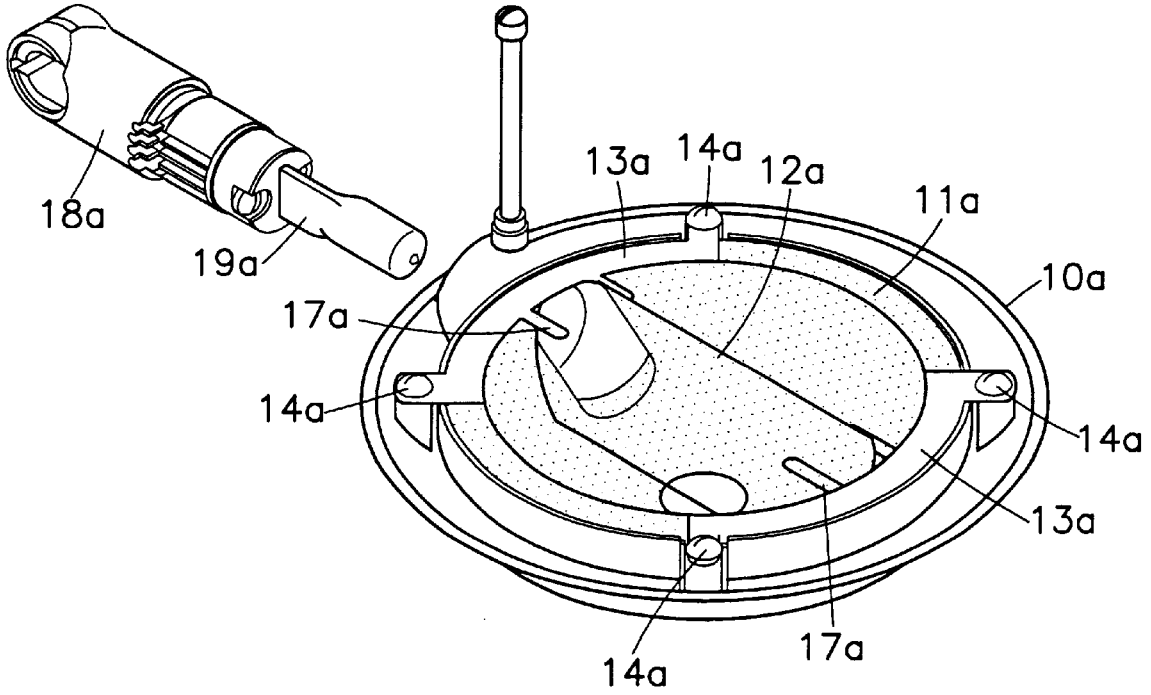
FIG. 1 PRIOR ART
Figure 2:
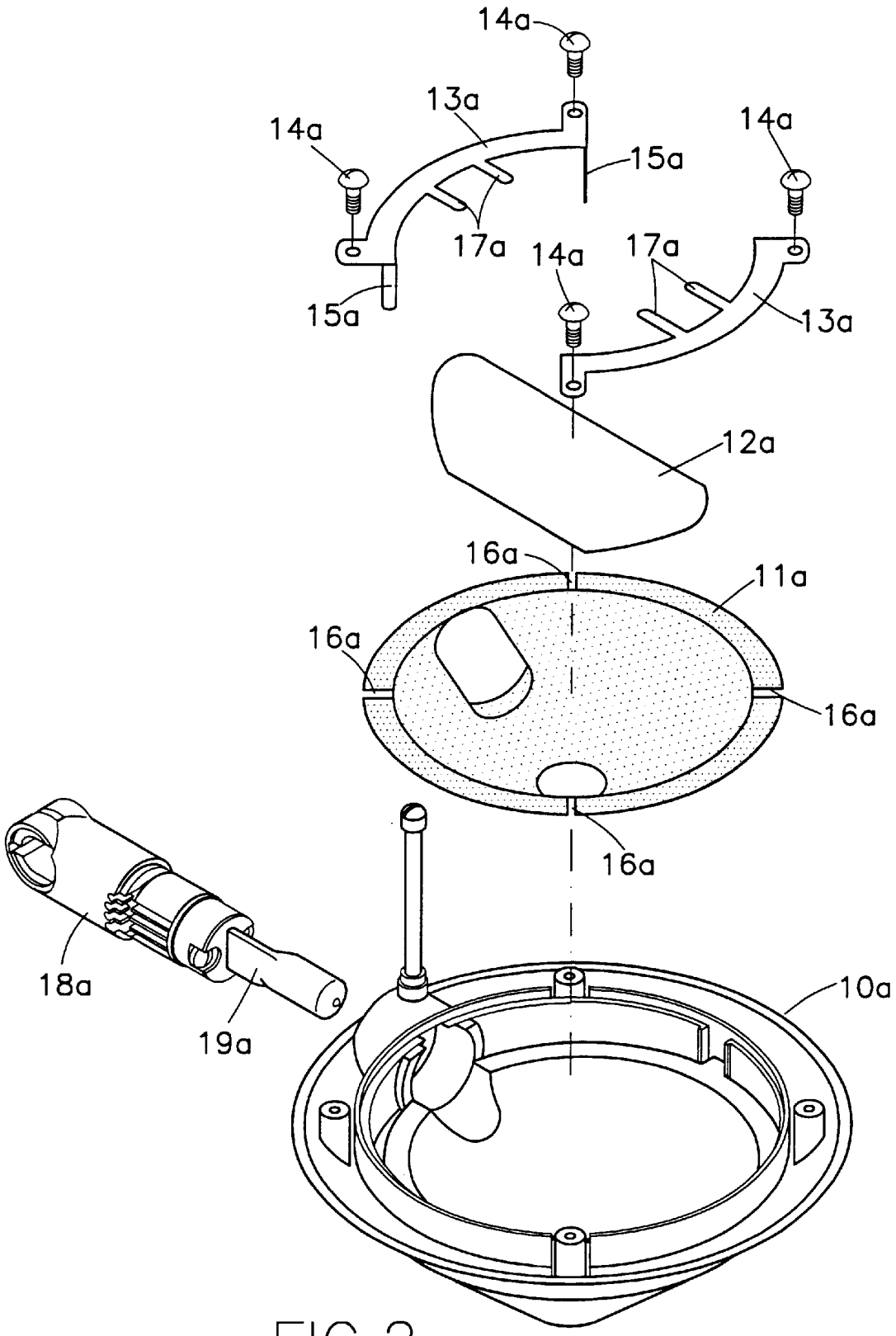
FIG.2 PRIOR ART
Figure 3:
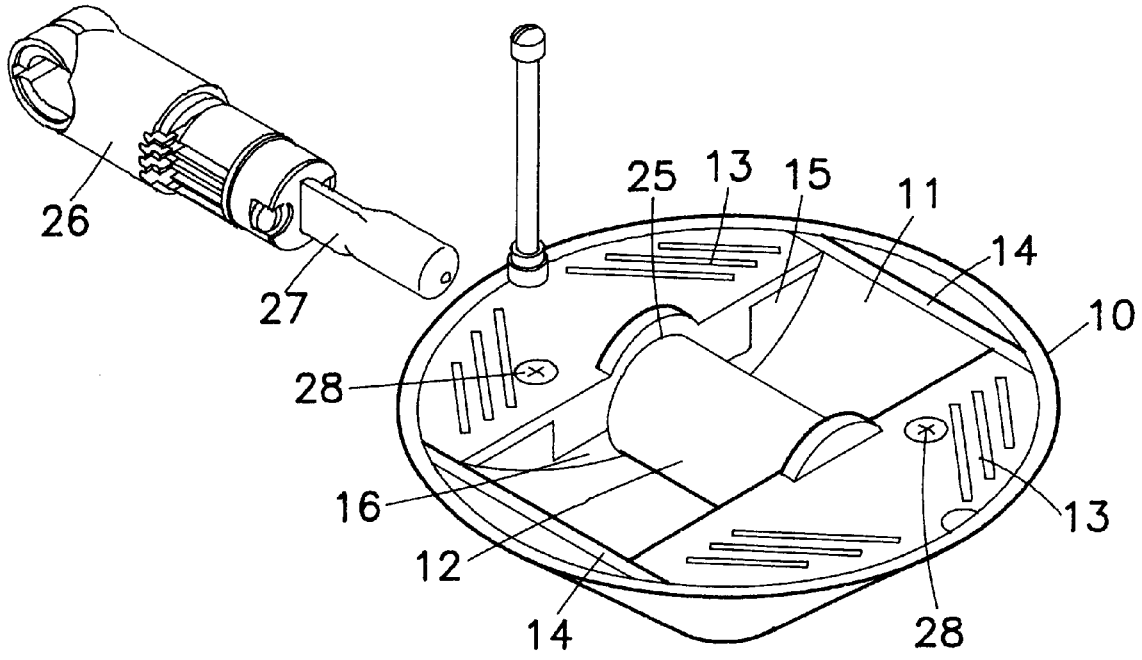
Figure 5:
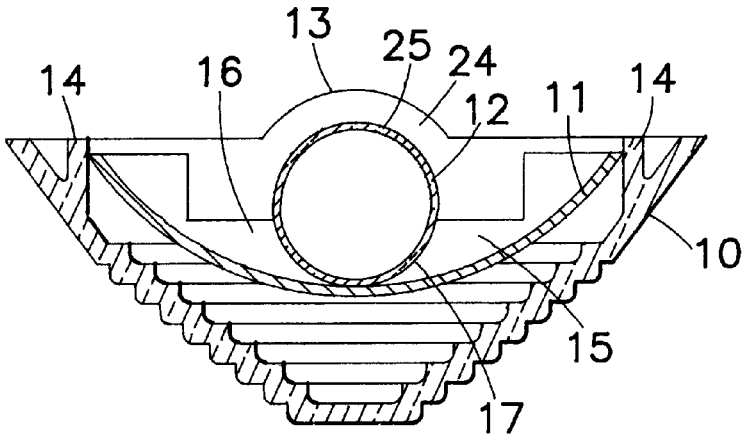
Figure 4:
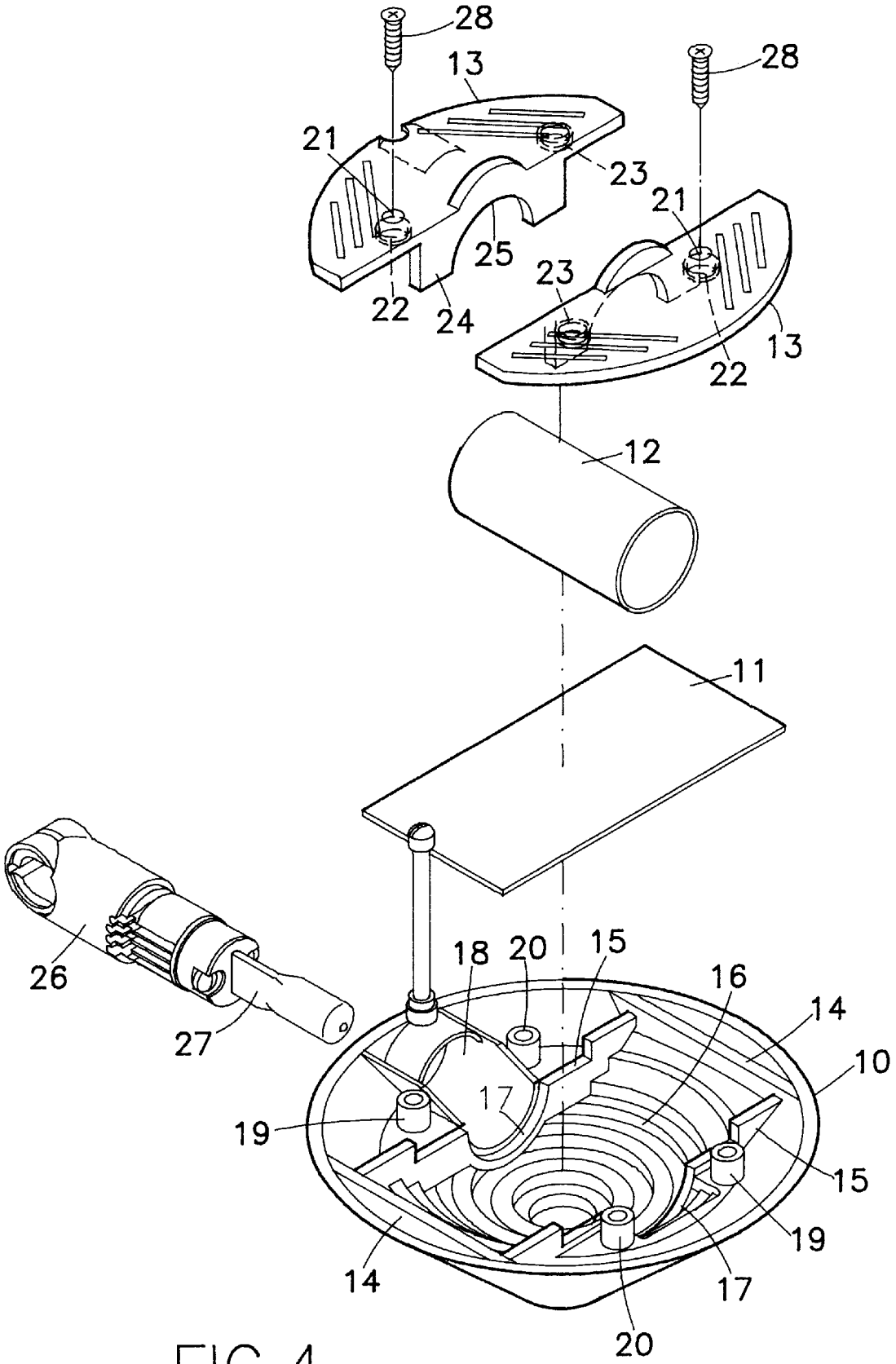

In view of the above description of light hood, we find problems and difficulties in its manufacturing which could be improved.

Therefore, the inventor, in realizing this need for improvement, have undergone a research with the usage of relevant theories, eventually I proposed a design that is reasonable and effective in improving the deficiencies above.

The main purpose of the invention is to provide a structure of light hood assembly. It consists of an outer hood, a reflection hood, a glass tube and two fixed chips. The reflection hood and the glass tube are fixed inside the positioning slot. The reflection hood is positioned upon its own tension. The fixed chips are screwed to the outer hood to press the reflection hood and the glass tube into their positions with fixation. Then the assembly of Light Hood structure is complete. This assembly is simple and easy with time saving, The reflection hood is a simplified rectangular shape, the glass tube is also a simplified cylindrical body which is empty inside. Its component parts are simple and its manufacturing is easy which all will cause the cost decreasing in manufacturing.

Description of Diagrams

The design and the function of the invention in accomplishing above structure and purpose of the structure is described as follows:

Diagram 1: the above mentioned light hood in 3-D assembly

Diagram 2: the above mentioned light hood in 3-D dissection

Diagram 3: the new inventive light hood in 3-D assembly

Diagram 4: the new inventive light hood in 3-D dissection

Diagram 5: the new inventive light hood in perspective plane

Numberings used in the diagrams:

10: outer hood
11: reflection hood
12: glass tube
13: fixed chips
14: short positioning plate
15: long positioning plate
16: positioning slot
17: positioning holes
18: connected slot
19: fixed support
20: positioning support
21: fixed hole
22: positioning ring
23: positioning ring
24: board structure
25: positioning hole
26: supporting arm
27: light bulb
28: screw
10*a*: outer hood
11*a*: reflection hood
12*a*: glass tube
13*a*: fixed chip
14*a*: screw
15*a*: positioning plate
16*a*: positioning hole
17*a*: convex chip
18*a*: supporting arm
19*a*: light bulb Diagram 3, 4, and 5 are respectively the 3-D Assembly Diagram 3-D Dissection Diagram and Perspective Plane in respect of my new invention. This invention provides an assembly of Light Hood structure. It consist of an outer hood (10), a reflection hood (11), a glass tube (12) and two fixed chips (13). The outer hood is a bottom-opening plate body with empty inside. Around its internal rim has two short positioning plates (14) in opposite position. On the two ends of these short positioning plates (14) there are two long positioning plates (15) in opposite position. The space among these four plates (14, 15) has formed a positioning slot (16). The space between the two long positioning plates has formed a semi-circle as the positioning hole (17), one positioning hole (17) is exteriorly connected a connective slot (18), this connected slot (18) is extended to the external of outer hood (10), also the external of the two long positioning plates (15) are set respectively one fixed support (19) and one positioning support (20).

The reflection hood is a form of rectangular shape. Its length is a little longer than the length of the positioning slot (16) of the outer hood (10). Its width is equivalent to the width of the positioning slot (16). This reflection hood (11)

is matched with the positioning slot. Due to the reason that the reflection hood is longer in length, so when the short positioning plates (14) are set on two upper ends of the reflection hood (11), the reflection hood (11) naturally to form an oval shape on itself, and make a position upon its own tension.

The glass tube (12) is a cylindrical shape with empty inside. It is open at the two ends to provide a better effect on heat emitting in accordance with the regulations. It is placed within the reflection hood (11) and its two ends are matched into the semi-circle positioning hole (17) at the center of the long positioning plates (15).

The fixed chips (13) is a structure with bottom-opening which is matched to the rim of the reflection hood (11) and the long positioning plate (15). On the fixed chips (13) has set with fixed support each (19) which matched to the fixed holes (21), also on the top of fixed chips (13) has set with fixed rings (22 & 23) which matched to the fixed support (19) and positioning support (20), on both sides of fixed chip (13) has set convexly one board structure (24), on the board structure (24) has set one semi-circle positioning hole (25) which matched with the positioning hole (17) of a long positioning plate (15). The two fixed chips (13) are placed respectively on the edge of reflection hood (11) and a recess formed in a respective long positioning plate (15), also the two chips (13) are matched to the top of fixed support (19) and positioning support (20) with the positioning rings (22, 23), in which the two fixed chips (13) will press the semi-circle positioning holes (25) of the two board structures (24) into the both ends of the glass tube (12), then by using one screw (28) to screw the fixed chip (13) and fixed support (19) through the fixed hole (21), in such fixation of fixed chip (13), the outer hood (10), reflection hood (11), glass tube (12) and fixed chip (13) will be assembled into one complete unit.

As to the hood structure as mentioned above, it may use the connected slot (18) of outer hood (10) properly in connection with the upper end of the supporting arm (26) of the lighting decoration, and the light bulb (27) on the upper end of supporting arm (26) could be placed inside of the glass tube (12), in which a lighting decoration will be completed. Because the structures of supporting arm (26) and light bulb (27) of the lighting decoration are within the area of common technology, but not belong the scope of the claim of my invention, so they won't be described in this explanation.

This invention is a structure in consisting of outer hood (10), reflection hood (11), glass tube (12) and fixed chips (13), etc. In assembling, it only needs to place the reflection hood (11) and the glass tube (12) in the positioning slot (16) of outer hood (10), the reflection hood (11) is positioned upon its own tension, two fixed chips (13) are screwed with the outer hood (10) by each screw (28) and to press the reflection hood (11) and glass tube (12) into their own positions, the assembly of light hood is completed. This assembly is simple and easy with time saving. The reflection hood (11) is a simplified rectangular shape, the glass tube is also a simplified cylindrical body which is empty inside. Its component parts are simple and its manufacturing is easy which all will cause the cost decreasing in manufacturing.

In concluding above explanation, this invention is actually made for the improvement of the deficiencies of common light hood: difficult to assemble, complex structure of component parts, hard production, and higher manufacturing cost; it is indeed a very new creation, with modern style and advancement.

What is claimed is:

1. A light hood structure comprising an outer hood, two short positioning plates and two long positioning plates formed within said outer hood, said short positioning plates and said long positioning plates opposing to each other, a space among the short and long positioning plates formed a positioning slot, each of said long positioning plates having a semi-circle positioning hole, a positioning support and a fixed support formed inside said outer hood, adjacent to each of said long positioning plates and outside of said space; a reflection hood, said reflection hood having a rectangular shape, said reflection hood having a length longer than a length of the positioning slot in the outer hood, said reflection hood disposed within said positioning slot with two ends of said reflection hood disposed against said short positioning plates forming an oval shape under tension of said reflection hood; a glass tube disposed within said positioning slot, said glass tube having a cylindrical shape having a hollow interior and opened ends, said opened ends corresponded within the semi-circle positioning holes of said two long positioning plates with said glass tube pressed onto a center of said reflection hood; two fixed chips, two fixed holes disposed in said fixed chips which corresponding to said fixed supports, each of said fixed chips having two positioning rings corresponding to the fixed support and the positioning support, a board extending from each of said fixed chips and having a semi-circle positioning hole which corresponding to each of said semi-circle positioning holes of each of said long positioning plates, said two fixed chips respectively disposed on side edges of said reflection hood with said semi-circle positioning holes of said fixed chips disposed opposite to said semi-circle positioning holes of said long positioning plates, a plurality of screws passing through said fixed holes and said fixed supports to secure said semi-circle positioning holes of said fixed chips onto both ends of said glass tube; and said fixed chips, said outer hood, said reflection hood with said glass tube assembled into one complete unit.

* * * * *